US007434768B2

(12) United States Patent
Humphrey et al.

(10) Patent No.: US 7,434,768 B2
(45) Date of Patent: Oct. 14, 2008

(54) PORTABLE TURNOUT SYSTEM

(76) Inventors: John J. Humphrey, 712 North St., Walnut, IA (US) 51577; Dean Wieser, 807 Hickory St., Atlantic, IA (US) 50022

( * ) Notice: Subject to any disclaimer, the term of this patent is extended or adjusted under 35 U.S.C. 154(b) by 155 days.

(21) Appl. No.: 11/292,189

(22) Filed: Nov. 30, 2005

(65) Prior Publication Data

US 2006/0124803 A1 Jun. 15, 2006

Related U.S. Application Data

(60) Provisional application No. 60/631,778, filed on Nov. 30, 2004.

(51) Int. Cl.
*E01B 7/00* (2006.01)

(52) U.S. Cl. ..... 246/374; 246/427; 246/429

(58) Field of Classification Search ..... 246/432, 246/374, 163, 376, 454, 465; 238/12
See application file for complete search history.

(56) References Cited

U.S. PATENT DOCUMENTS 824,271 A * 6/1906 Aldrich ..... 238/12
1,341,354 A * 5/1920 Booth ..... 238/12
3,924,718 A * 12/1975 Kornylak ..... 193/35 R
4,895,335 A * 1/1990 Oliver ..... 248/354.3

* cited by examiner

*Primary Examiner*—Mark T Le

(57) ABSTRACT

A portable turnout system for temporary connection of a rail line to a spur line includes a ramp section having a frame and two parallel rails mounted thereon, the parallel rails each having a forward end and a rearward end higher than the forward end such that the parallel rails have a positive grade from forward end to rearward end and a portable transfer track including at least one portable track section having a frame and two parallel rails mounted thereon, the portable transfer track releasably connectable at one end thereof to the rearward end of the parallel rails of the ramp section in an elevated position above the rail line. At least one portable transfer track support device supports the portable transfer track in the elevated position above the rail line and the portable transfer track is releasably connectable at the opposite end thereof to a spur line.

11 Claims, 14 Drawing Sheets

PORTABLE TURNOUT SYSTEM

CROSS-REFERENCE TO RELATED PROVISIONAL PATENT

This application claims priority based on a provisional patent, specifically on the Provisional Patent Application Ser. No. 60/631,778 filed Nov. 30, 2004.

BACKGROUND OF THE INVENTION

1. Technical Field

The present invention is directed to portable railroad track devices and, more particularly, to a portable turnout system which includes a ramp section, a plurality of curved track panels which connect to and extend rearwards from the ramp section and a plurality of support devices such as outriggers for at least partially supporting the curved track panel sections adjacent the permanent main track line on which the portable turnout system is to be mounted in order to permit repair equipment and the like to be quickly and easily moved on to and off of the permanent railroad main track line.

2. Description of the Prior Art

With many thousands of miles of track in the United States, railroad companies such as Union Pacific and Burlington Northern Santa Fe must remain constantly vigilant for track damage or other problems which would render the track inoperable for use. There have been numerous developments in the field of railroad track damage determination and repair and the speed with which a repair crew can operate can be quite impressive. One problem which remains unsolved, however, is how to permit the repair crew to have enough time on the railroad line to complete the repair or to perform necessary maintenance work. In the case of main line repair, a repair crew may only have six hours or so to make repairs before having to get off of the line to permit a train to go through. While this amount of time is usually sufficient to complete many repairs, such is not the case when the repair must be performed in a remote location, particularly in a location which does not have a nearby turnout to permit the repair crew's equipment to be removed from and replaced on the main line. In fact, it is not uncommon for the repair crew to have to travel upwards of twenty to thirty miles from the nearest spur line to the repair location, and all of that travel time takes away from the repair time available to the repair crew. There is therefore a need for a portable turnout system which can be used in many different locations to permit a repair crew to quickly remove their equipment from the main line onto a temporary spur line and then quickly replace the equipment on the main line as soon as the main line has been used to continue the repair operation.

Another important need for any portable turnout system is that it engage the railroad track line to permit the transfer of equipment on and off the railroad track line in such a manner as to not require modification of the railroad track line itself. For example, current technology for spur lines requires the installation of a switch on the line to transfer the equipment from the line to the spur. Clearly, the installation of a switch on a line is a major undertaking, and a temporary spur line would not only need to have the switch installed but then also removed to put the line back in its original configuration. There is therefore a need for a portable turnout system which will be able to be installed on and removed from a rail line without requiring substantial modification of the rail line itself.

Therefore, an object of the present invention is to provide a portable turnout system for use on rail lines and for connection to a temporary spur line.

Another object of the present invention is to provide a portable turnout system which includes a ramp section mountable on the rail line, a portable transfer track connectable to the ramp section and further including at least one portable track section, at least one portable transfer track support device for supporting the portable transfer track and the portable transfer track connectable at the opposite end thereof to a spur line.

Another object of the present invention is to provide a portable turnout system which is mountable on the rail line without requiring substantial modification of the rail line so that the portable turnout system is useable at many locations along the rail line to facilitate repairs to the rail line.

Another object of the present invention is to provide a portable turnout system which can quickly and easily be installed and removed from the rail line.

Another object of the present invention is to provide a portable turnout system which is height-adjustable to accommodate variations in the elevation and terrain of the location adjacent the rail line so that the temporary turnout can be used in less than ideal locations.

Finally, an object of the present invention is to provide a portable turnout system which is relatively simple and inexpensive to manufacture and is safe, efficient and effective in use.

SUMMARY OF THE INVENTION

The present invention provides a portable turnout system for temporary connection of a rail line to a spur line including a ramp section having a frame and two parallel rails mounted on the frame, the parallel rails each having a forward end and a rearward end higher than the forward end such that the parallel rails have a positive grade from the forward end to the rearward end and a portable transfer track including at least one portable track section having a frame and two parallel rails mounted on the frame, the portable transfer track releasably connectable at one end thereof to the rearward end of the parallel rails of the ramp section in an elevated position above the rail line. At least one portable transfer track support device is operative to support the portable transfer track in the elevated position above the rail line and the portable transfer track is releasably connectable at the opposite end thereof to a spur line whereby a temporary turnout from the rail line to the spur line is constructed.

As thus described, the portable turnout system of the present invention provides numerous advantages for rail line repair technicians and others who work with railroads. For example, because the present invention can be placed on virtually any length of track adjacent to which a temporary spur line can be set up, the amount of time that the rail line would need to be shut down becomes far less dependent on the location of the repair as opposed to the nature of the repair, and therefore rail line disruptions will be significantly lessened. Furthermore, because the present invention does not require significant modifications to the rail line to permit the turnout system to be placed on and used with the rail line, it can be used in virtually any situation where the specific physical requirements for use of the invention are met, and the use of the invention will thus neither degrade nor destroy the rail line. Finally, the present invention can be quickly installed and removed from the rail line, which permits the portable turnout device to be removed to allow a train to pass, then replaced so that repairs can continue. The portable turnout device of the present invention thus provides a substantial improvement over those devices and methods found in the prior art.

DESCRIPTION OF THE PREFERRED EMBODIMENT

Figure 10:
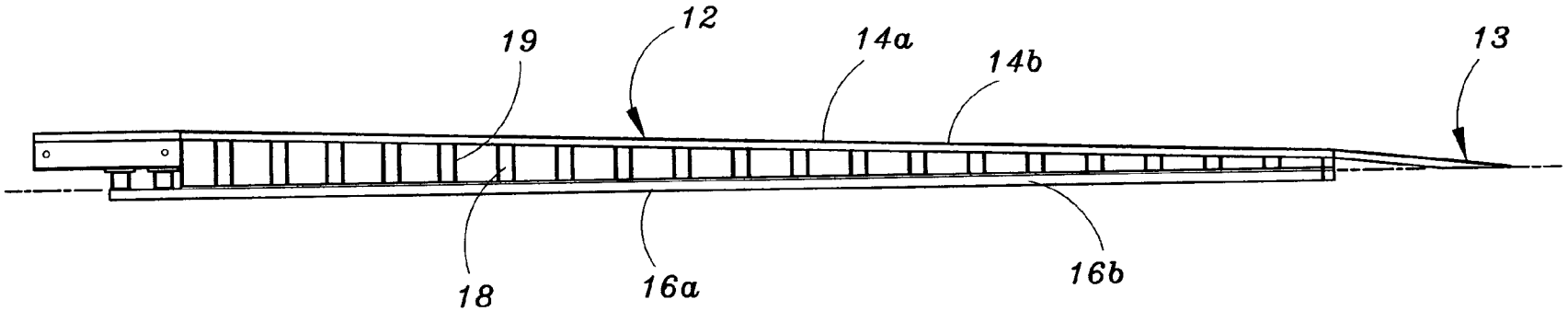
FIG. 10 is a side elevational view of the ramp section of the present invention which is mounted on the main track itself.

The portable turnout system 10 of the present invention is shown best in FIGS. 1-10 as including a ramp section 12 and a portable transfer track 200 which includes a plurality of turnout panels 20, 30, 40, 50, 60, 70, 80, and 90. It should be noted that all of the construction materials used in connection with the portable turnout system 10 should be of high structural strength and relatively high quality to ensure safety and longevity in use of the portable turnout system 10. Therefore, it is expected that the portable turnout system 10 would be constructed of high-grade steel such as that commonly used in connection with railroad rails to ensure that the portable turnout system 10 functions as intended. The ramp section 12 is shown best in FIGS. 1 and 10 as including two parallel rails 14*a* and 14*b* each of which are approximately twenty feet long and are constructed to replicate the top support section of a standard railroad rail. Parallel main line engagement plates 16*a* and 16*b* extend below the parallel rails 14*a* and 14*b*, as shown in FIG. 10, and a plurality of rail support struts 18 extend upwards between the main line engagement plates 16*a* and 16*b* and parallel rails 14*a* and 14*b* such that the rails 14*a* and 14*b* ramp upwards from adjacent to and contacting the main line rails at the front end towards the rear end of the ramp section 12. It is expected that the maximum height of the rail support struts 18 and thus the height of parallel rails 14*a* and 14*b* would be approximately four to eighteen inches to provide sufficient clearance for the portable turnout system 10 of the present invention above the main line 100 yet still have a relatively small uphill grade to permit equipment to be propelled up the ramp section 12 under their own power without requiring additional sources of propulsion. Finally, a plurality of cross beams 19 are mounted on and extend between the main line engagement plates 16*a* and 16*b* and selected ones of the rail support struts 18 on opposite sides of the ramp section 12 to provide structural stability to the ramp section 12. This permits the ramp section 12 to be moved as a single unit for placement on and removal from the main line 100.

Each of the turnout panels 20, 30, 40, 50, 60, 70, 80, and 90 of the portable transfer track 200 are generally similar to one another with the significant differences being only in the structural connection between the rails for purposes of structural stability and the positioning of panel support channels which are designed to fit over and engage the main line 100 depending on the positioning of each of the turnout panels 20, 30, 40, 50, 60, 70, 80, and 90. Therefore, the following description of turnout panel 50 should be understood to apply generally to each of the other turnout panels 20, 30, 40, 50, 60, 70, 80, and 90. Turnout panel 50 is shown best in FIG. 5 as including two parallel rails 52*a* and 52*b*, which are preferably standard rails and which are connected to one another by a plurality of cross beams 54 which are mounted beneath the rails 52*a* and 52*b* and support the rails thereon. In the preferred embodiment, the parallel rails 52*a* and 52*b* would be slightly curved at approximately a 500 foot radius to provide sufficient curvature to permit the portable turnout system 10 to shift from the position directly above the main line 100 to a position parallel with the main line and offset therefrom to permit the temporary spur line 102 to extend therefrom.

Figure 5:
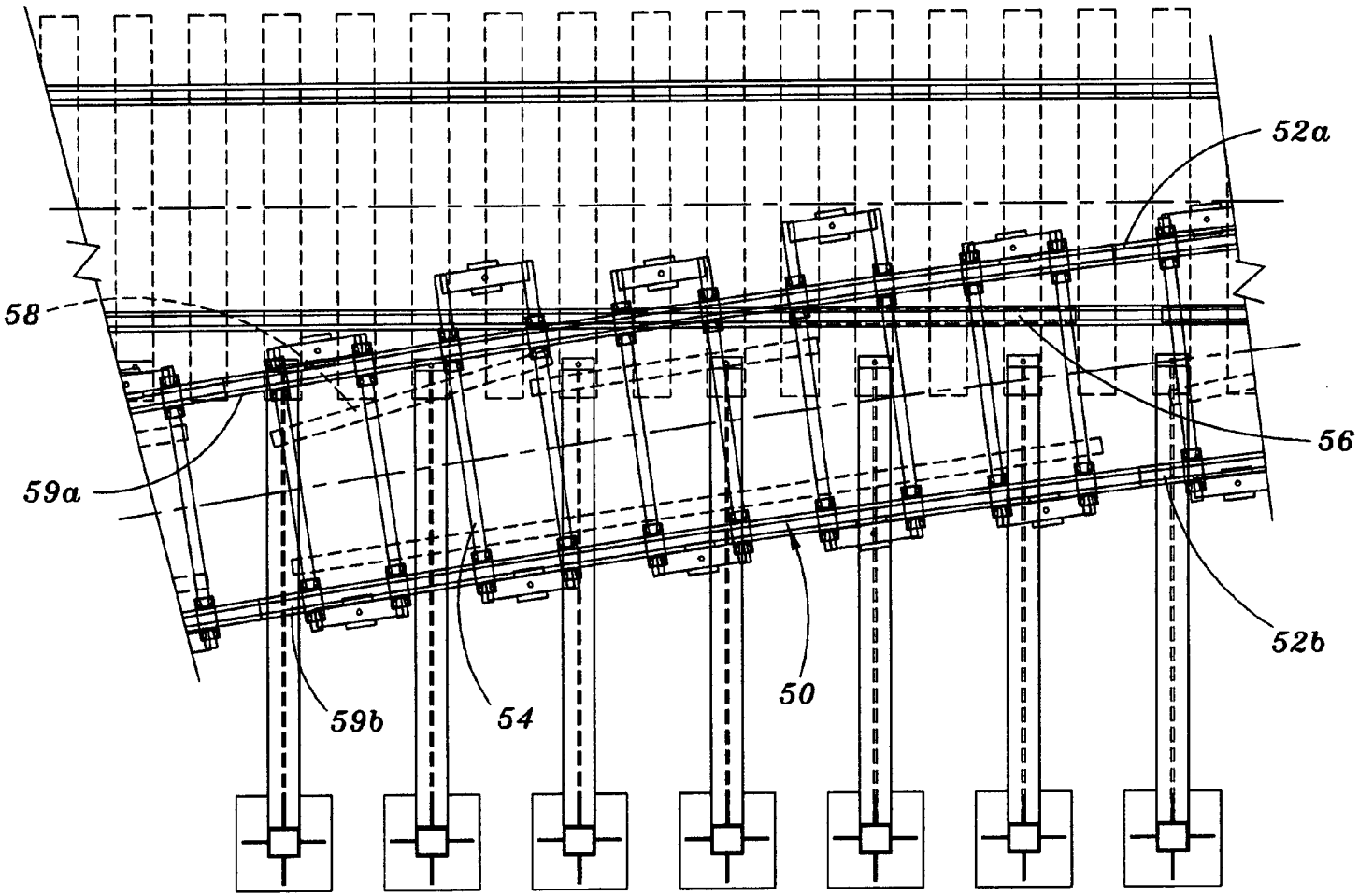
Figure 6:
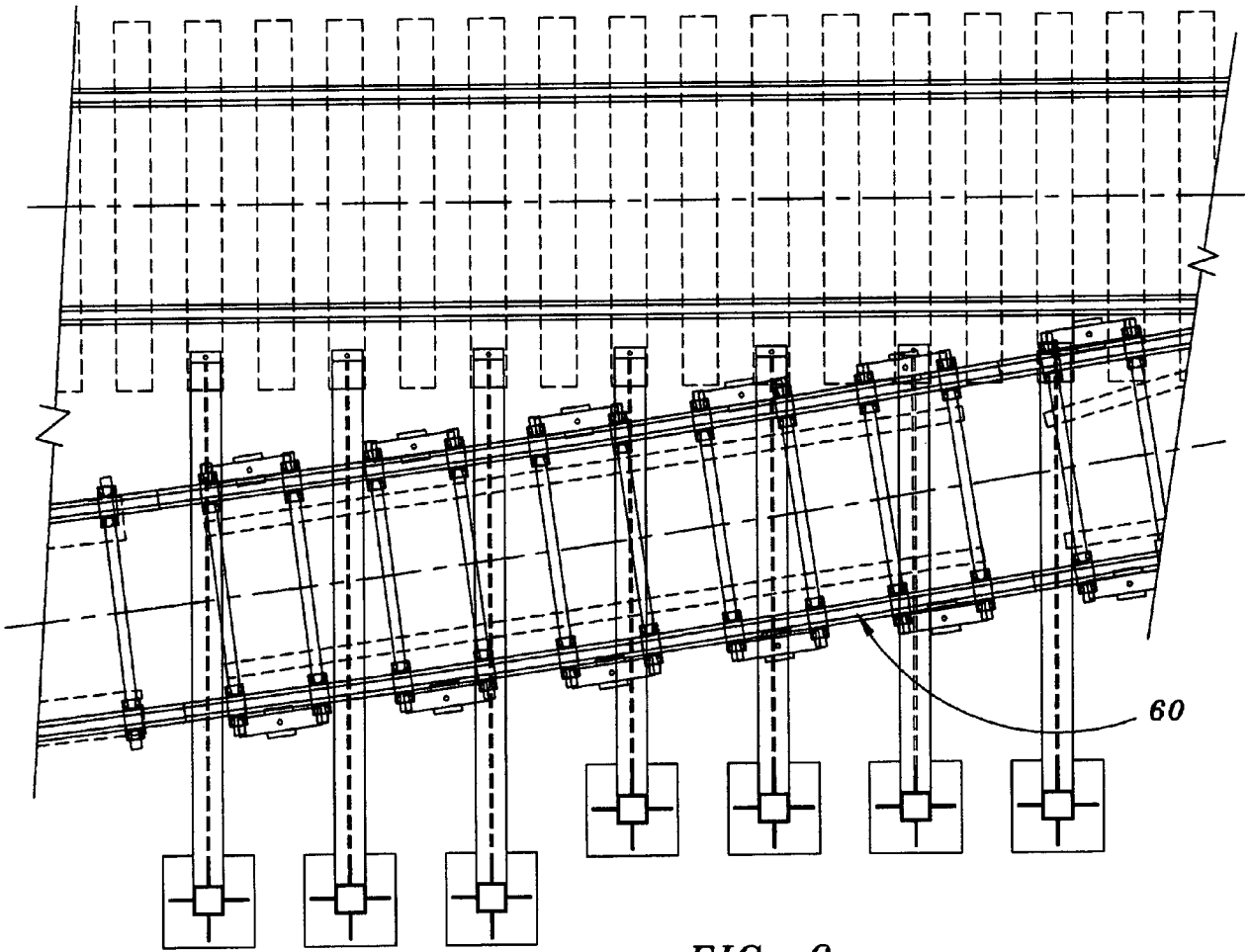
Figure 7:
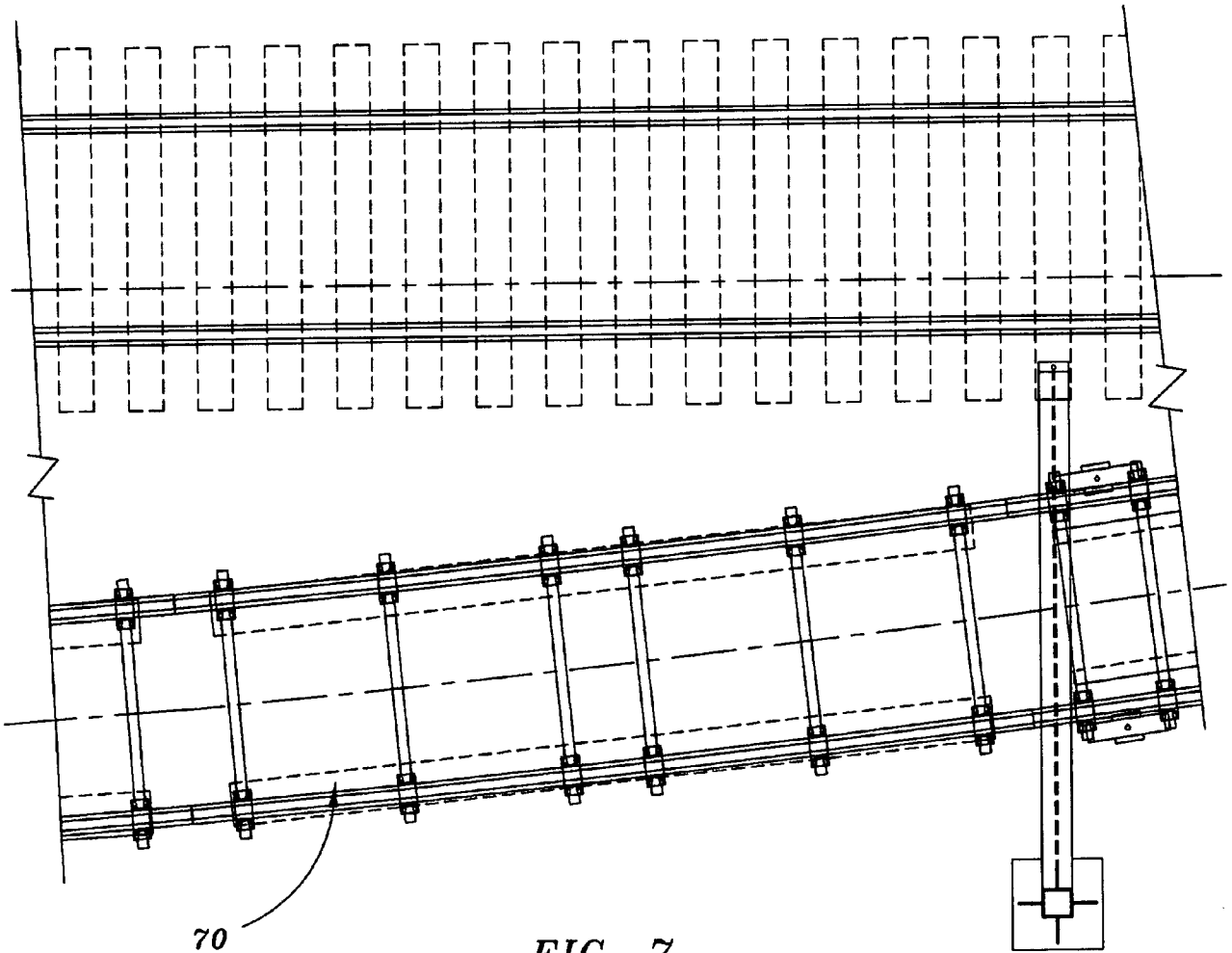
Figure 8:
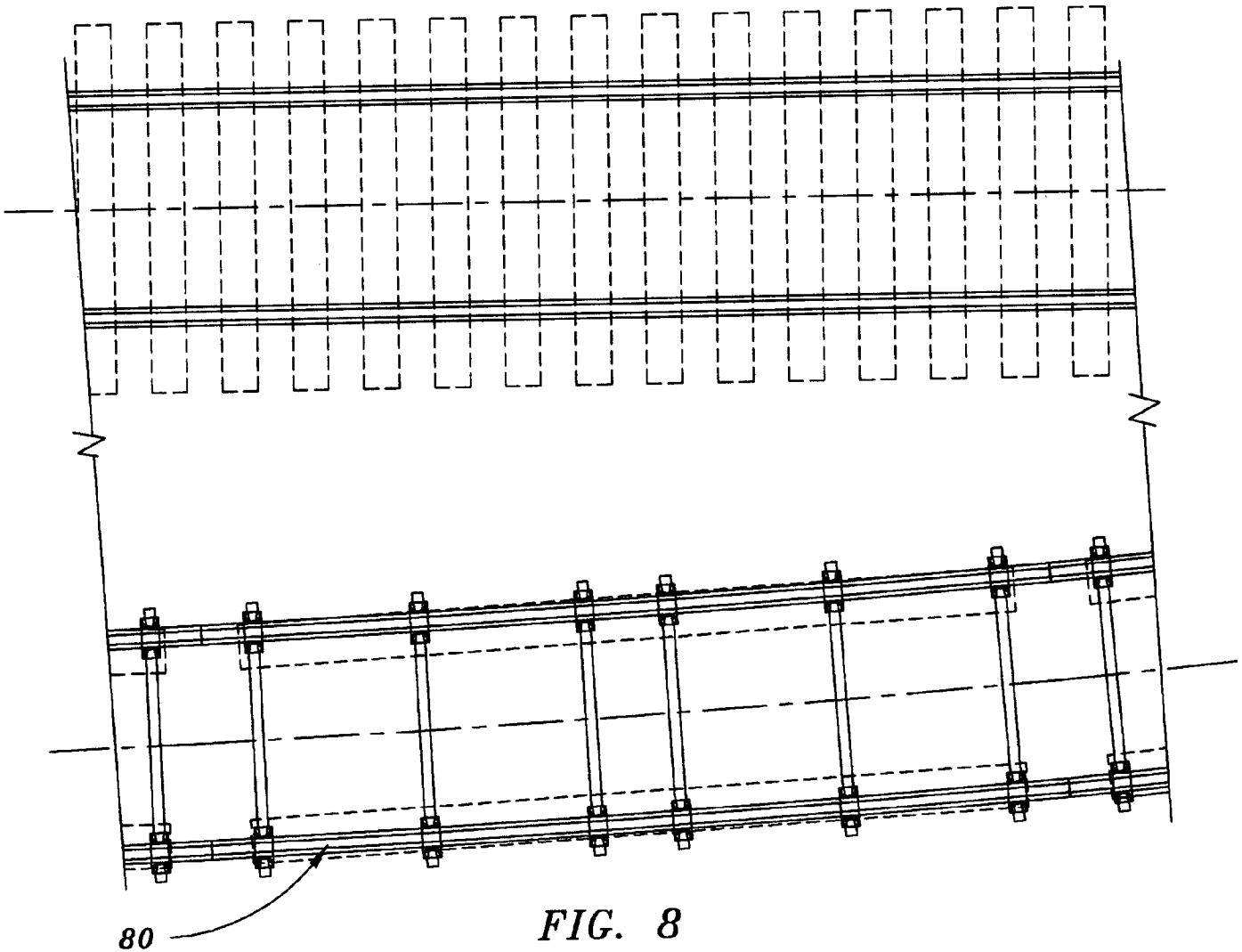
Figure 9:
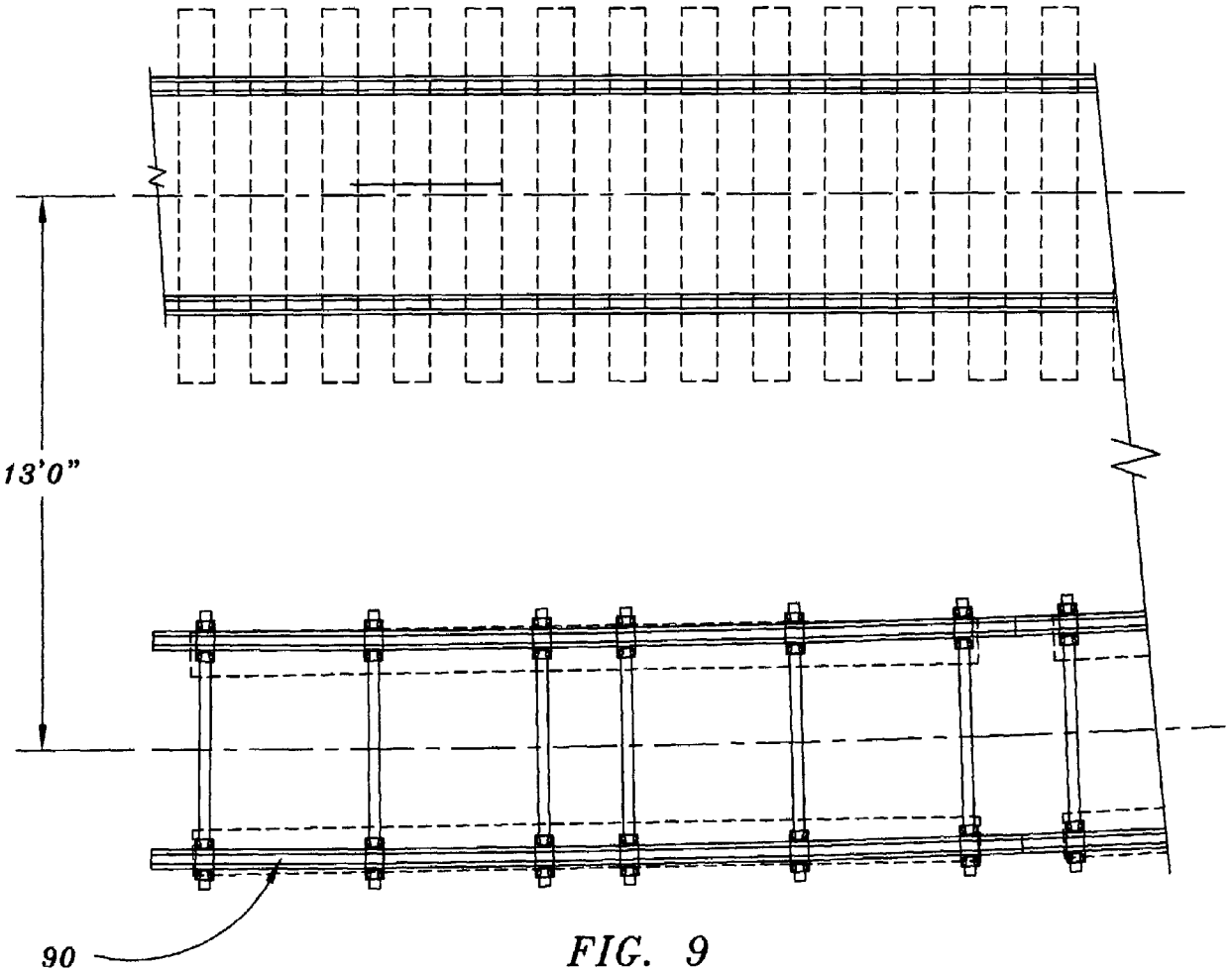

Mounted beneath the cross beams 54 is a main line rail engagement channel 56 which would be mounted in the appropriate location underneath cross beams 54 and would extend over the main line 100 positioned there beneath to both protect the main line 100 and provide additional structural and positional stability for the turnout panel 50. In the preferred embodiment, the main line rail engagement channel 56 would have a generally inverted cross-sectional C-shape which fits over the rail of main line 100, as shown in FIG. 5. Again, as a reminder, it should be noted that the drawing of FIG. 5 shows a left hand turnout for the portable turnout system 10 of the present invention. In the case of a right hand turnout, the turnout panel 50 has a second main line rail engagement channel 58 mounted underneath cross beams 54 and positioned to engage the rail of main line 100 on the opposite side thereof to permit the turnout panel 50 to extend in a right hand turnout formation merely by switching the panel to the opposite side of the main line 100 and reversing it.

Each of the other turnout panels 20, 30, 40, 60, 70, 80, and 90 each include appropriate main line rail engagement channels mounted beneath their respective cross beams to engage the main line 100 if the turnout panel section with which they are associated crosses over the main line 100. Also, the outer turnout panels 70-90 may further include parallel mounting flats 59*a* and 59*b*, which extend beneath the parallel rails 52*a* and 52*b* underneath the cross beams to allow the turnout panels 70-90 to be placed directly on a ground surface or be cribbed or blocked up to the appropriate height above the ground surface as well as provide additional support for the parallel rails 52*a* and 52*b*. The exact sizes, shapes, and dimensions of the cross beams 54 and mounting flats 59*a* and 59*b* is critical to the present invention only in that the functionality of the turnout panels 20-90 must be maintained and the rails 52*a* and 52*b* be properly supported to permit use of the present invention.

Each of the turnout panels 20-60 would also preferably include a plurality of portable transfer track support devices such as jack devices 120 mounted on the turnout panels 20-60 both inside and outside of the rails 52*a* and 52*b* which are each designed to extend downwards from the underside of the turnout panels 20-60 and contact the tie positioned there below in order to stabilize the turnout panels 20-60 when they are placed on the main line 100. Although the exact type of the jack device 120 is not critical to the proper functionality of the present invention, the preferred form of the jack device 120 is shown best in FIGS. 12-16 as including a mounting plate 150 extending between two of the cross beams 54, the mounting plate 150 including two stiffening struts 152*a* and 152*a* extending above the mounting plate 150 between the cross beams 54 to render the mounting plate 150 more secure. The jack device 120 includes an upright threaded acme screw rod 122 which extends downwards through a hole in the mounting plate 150 and would have a length of approximately 8" to 16". Fixedly mounted at the top end of the acme screw rod 122 is an engagement nut 124, and a mounting nut 126 is fixedly mounted below and in line with the hole in the mounting plate 150 such that the acme screw rod 122 threadably mounts to and extends through the mounting nut 126 so that rotation of the acme screw rod 122 adjusts the extension and thus the length of the acme screw rod 122 below the mounting nut 126.

Mounted to the base of the acme screw rod 122 is a foot plate 130 which includes an upwardly extending foot mount cylinder 132 mounted on the foot plate 130 generally concentrically therewith and having a mounting ring 134 attached to the upper end thereof which extends inwards towards the center of the foot mount cylinder 132 to narrow the diameter of the upper end of the foot mount cylinder 132. The mounting ring 134 has an inner diameter less than the outer diameter of the acme screw rod 122, and the acme screw rod would thus include a ring-engaging groove 128 into which the inner edge of the mounting ring 134 extends to rotatably mount the foot plate 130 on the acme screw rod 122. Finally, mounted within the foot mount cylinder 132 between the base of the acme screw rod 122 and the foot plate 130 is a friction-reducing disk 136 preferably constructed of UHMW polyethylene, which prevents binding between the base of the acme screw rod 122 and the foot plate 130 when the foot plate 130 is turning beneath the acme screw rod 122. The functioning of the jack device 120 will be described following the discussion of the use of the portable turnout system 10 itself.

The portable turnout system 10 of the present invention would be used in the following manner. First of all, an appropriate location nearby the location to be repaired would be found. An appropriate location is any generally level or levelable stretch of ground adjacent the main line 100 on which the temporary spur line 102 may be placed and preferably would include a lack of significant height deviation from the main line 100 to the adjacent ground. Also, an appropriate location would be close to the repair site on the main line 100 to decrease the travel time necessary to get the equipment from the temporary spur line 102 to the repair location on the main line 100, and the individual workers will be best equipped to make the determination of the location of the portable turnout system 10 of the present invention. In the initial stages of installation of the portable turnout system 10, the ramp section 12 would be placed on the main line 100 with the forward end 13 of the ramp section 12 extending down the main line 100 towards the location of the repair. The parallel rails 14*a* and 14*b* adjacent forward end 13 of ramp section 12 are positioned adjacent the main line 100 such that equipment rolling on the main line 100 will ramp up onto the parallel rails 14*a* and 14*b* of ramp section 12 and the equipment would then be transported vertically upwards as the equipment moves along ramp section 12 towards the rearward end 15 of ramp section 12. The portable transfer track 200 would then be attached to the rearward end 15 of ramp section 12, specifically turnout panel 20, as shown best in FIG. 1, with the connection between the turnout panel 20 and ramp section 12 being of any appropriate kind, but in the preferred embodiment would be a bolted rail connection such that the parallel rails 14*a* and 14*b* of ramp section 12 connect directly to the parallel rails 22*a* and 22*b* of turnout panel 20. As shown best in FIG. 2, the curvature of turnout panel 20 begins to direct the portable turnout section 10 away from alignment with main line 100. However, due to the diameter of turnout panel 20, the turn is rather gradual, thus permitting many different types of equipment to be transferred from the main line 100 on the portable turnout system 10 to the temporary spur line 102. Also, as was previously described, the main line rail engagement channels mounted underneath the turnout panel 20 engage the main line 100 to prevent side-to-side motion of the turnout panel 20, which is vital for safety and stability when equipment is being moved onto or off of the main line 100 via the portable turnout system 10.

Figure 1:
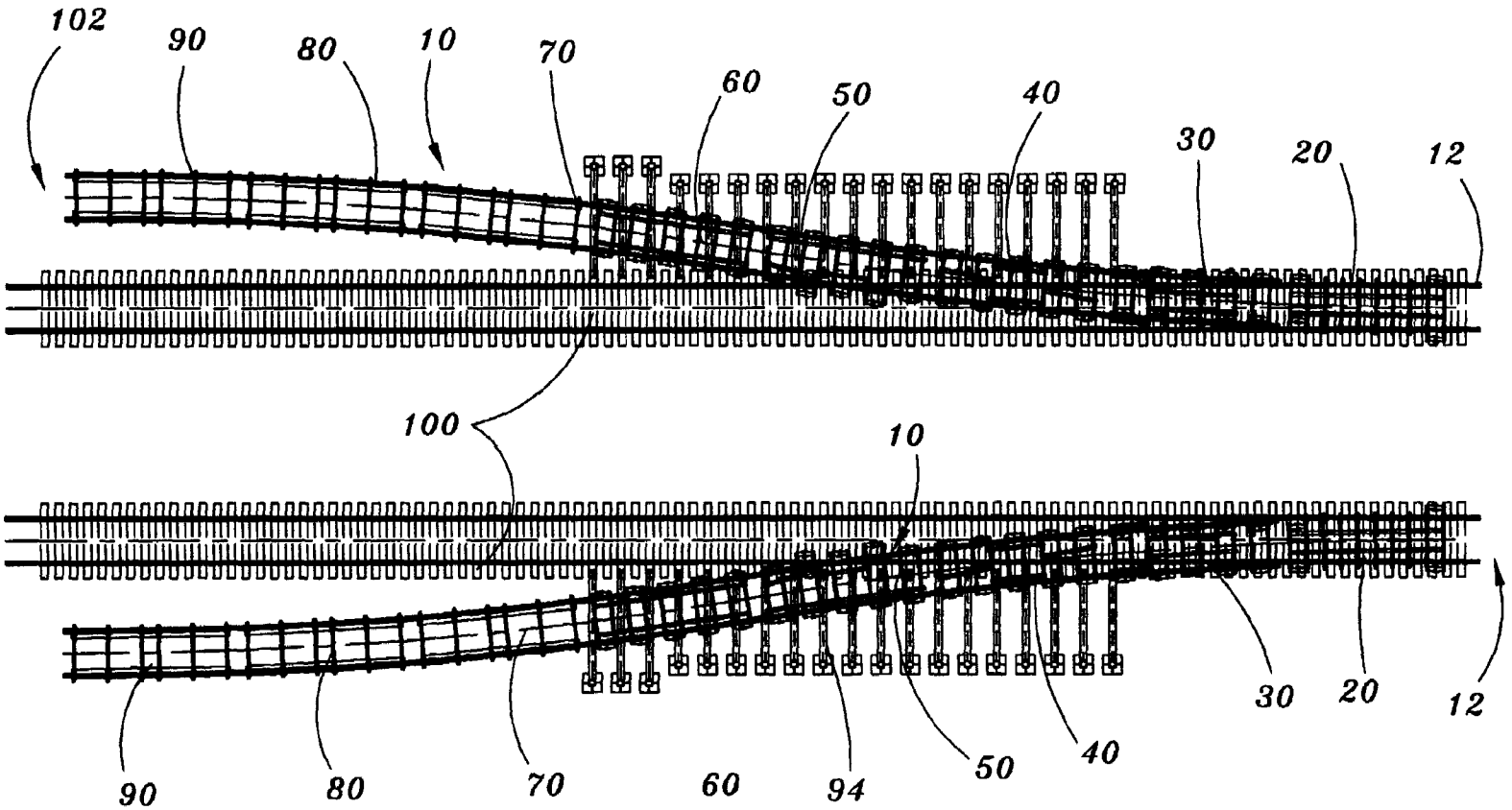
FIG. 1 is a top plan view of the portable turnout system of the present invention being used in both a right hand and left hand turnout configuration.
Figure 2:
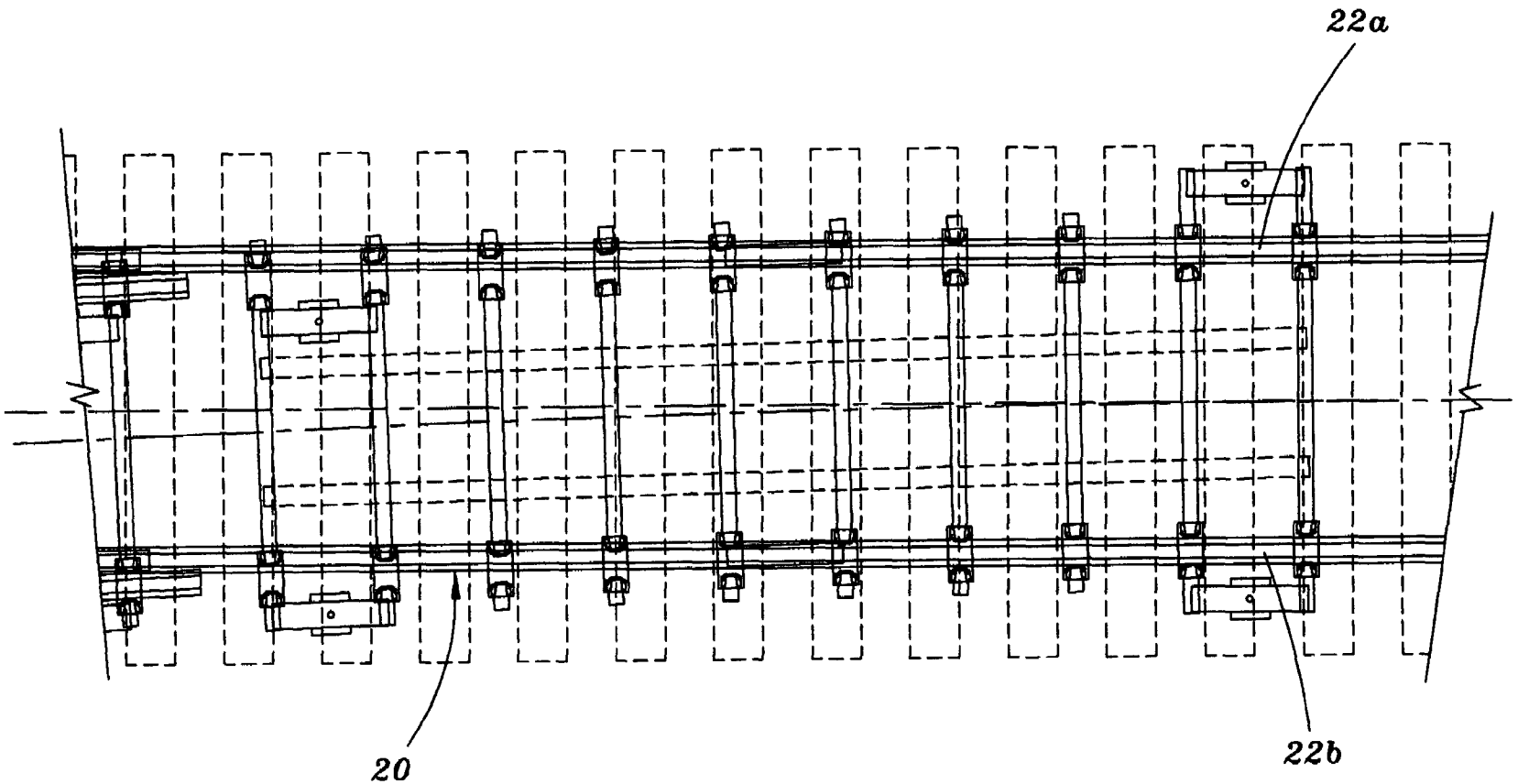
FIGS. 2-9 are each top plan views showing the eight panels of the portable turnout system of the present invention and their positioning adjacent the main track to form a left hand turnout.
Figure 3:
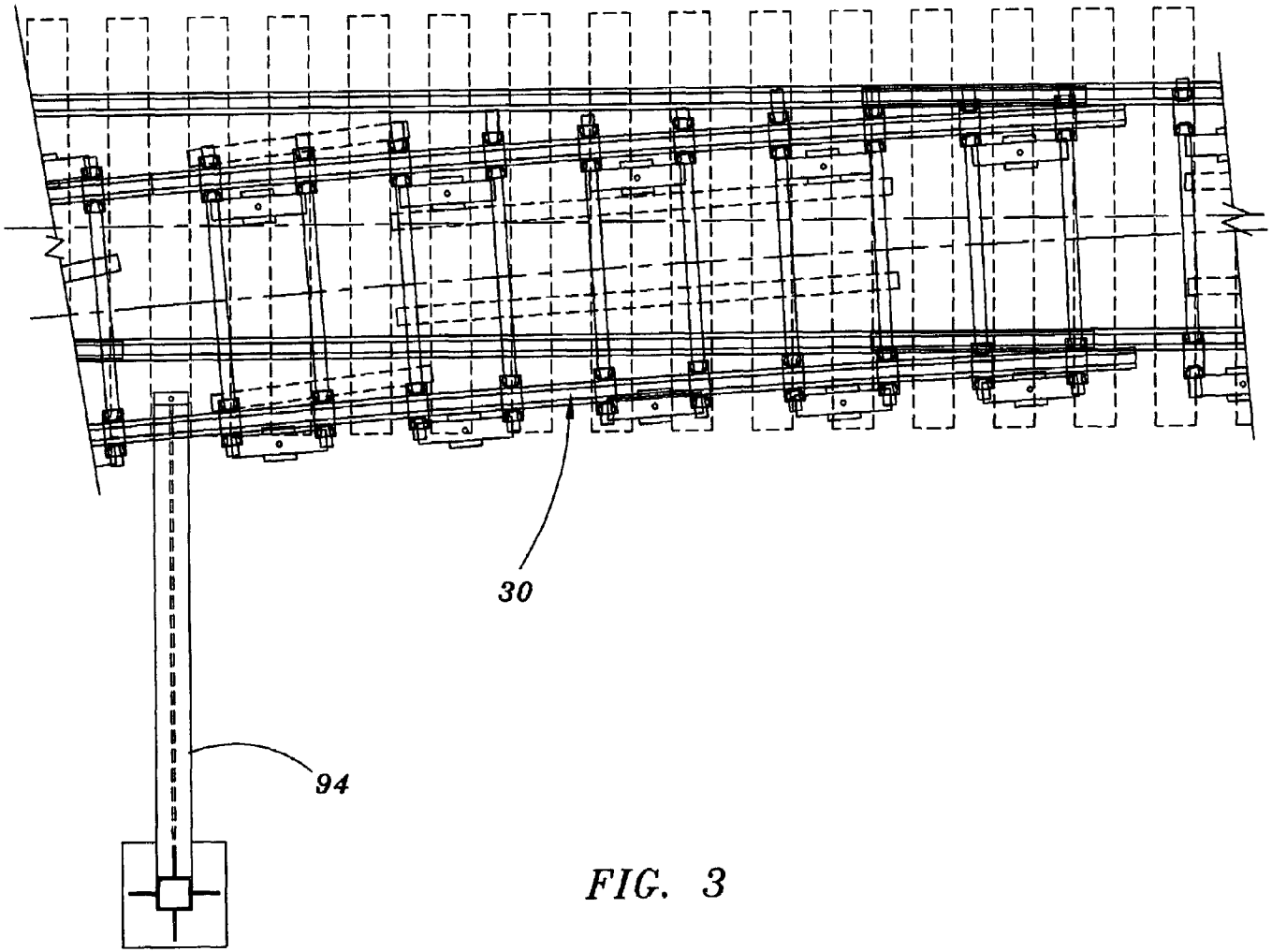
Figure 4:
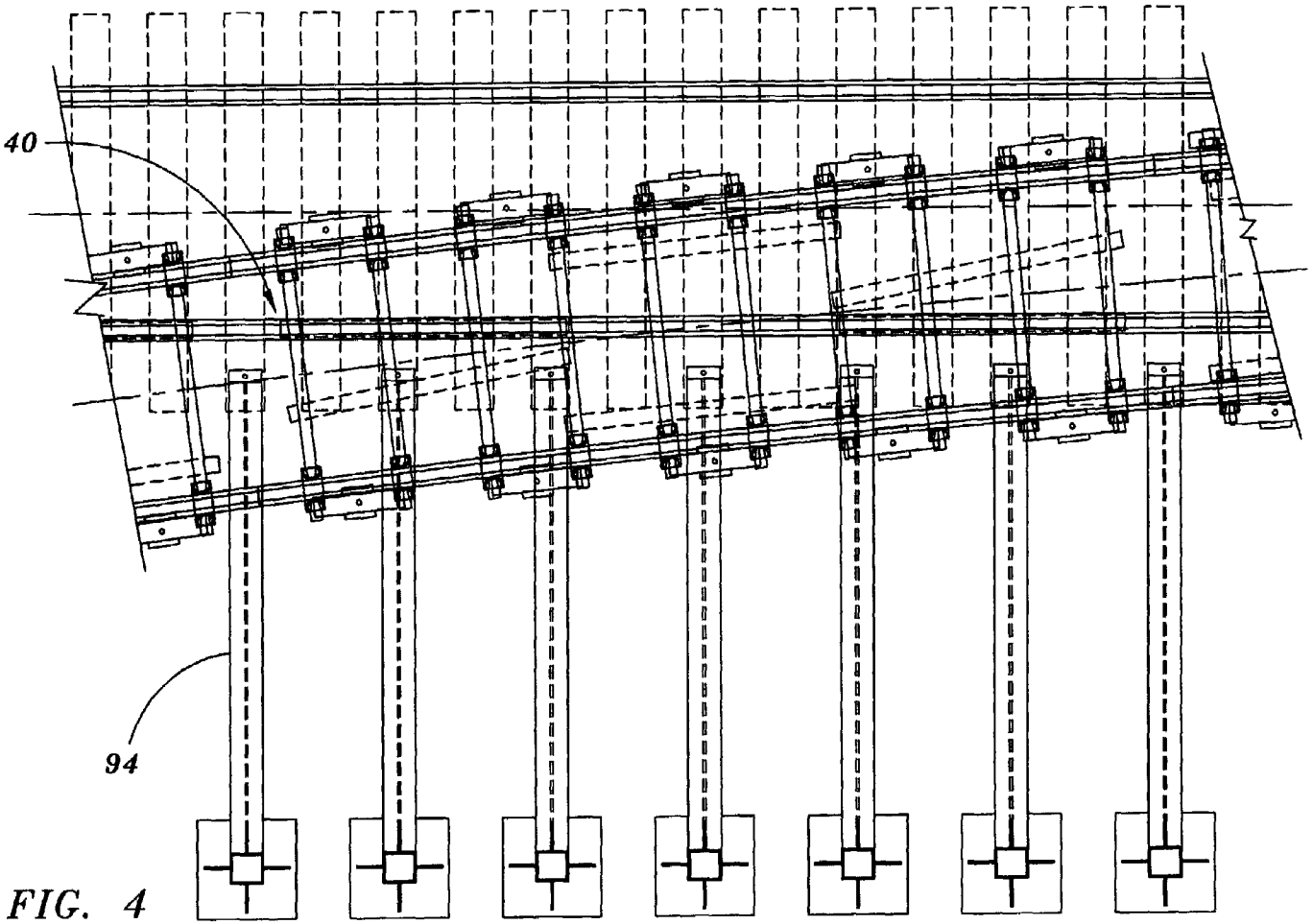
Figure 11A:
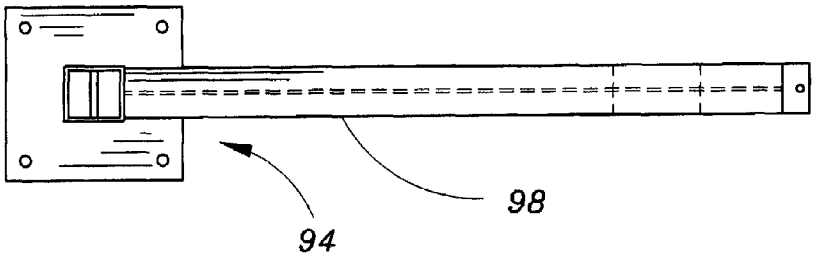
FIG. 11 is a side elevational view of an outrigger unit connected to the main line for at least partially supporting the portable turnout system of the present invention.
Figure 11B:
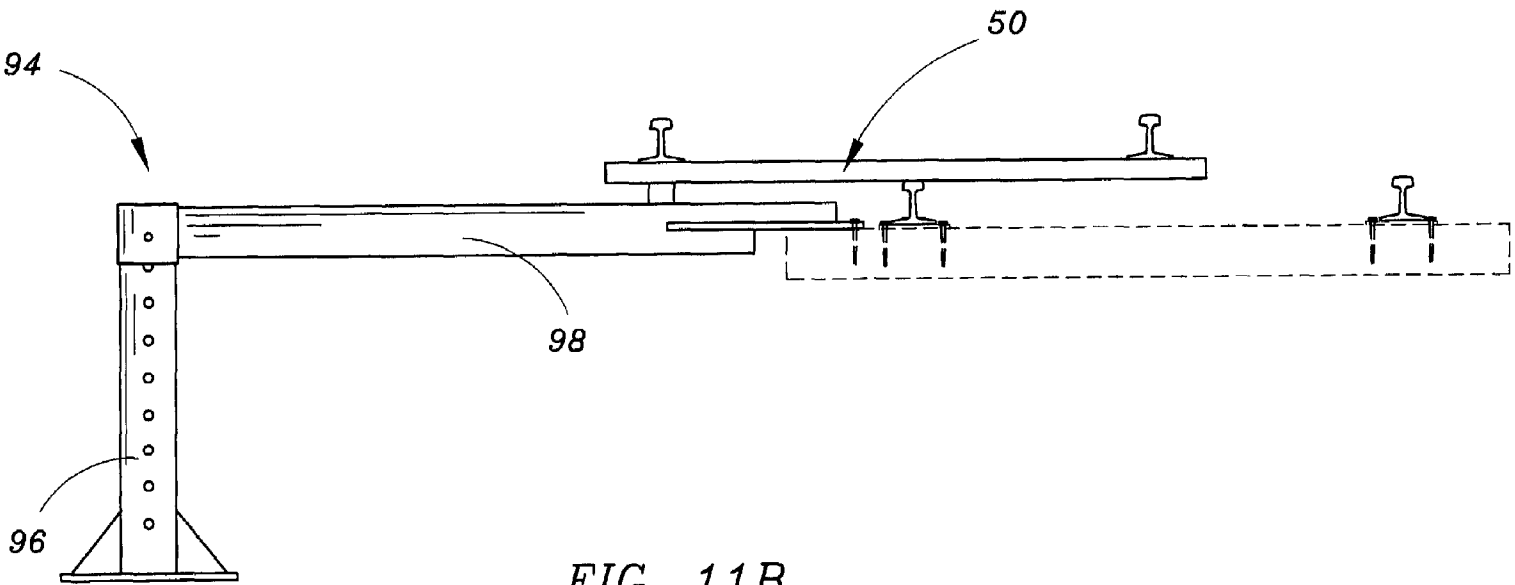
Figure 13:
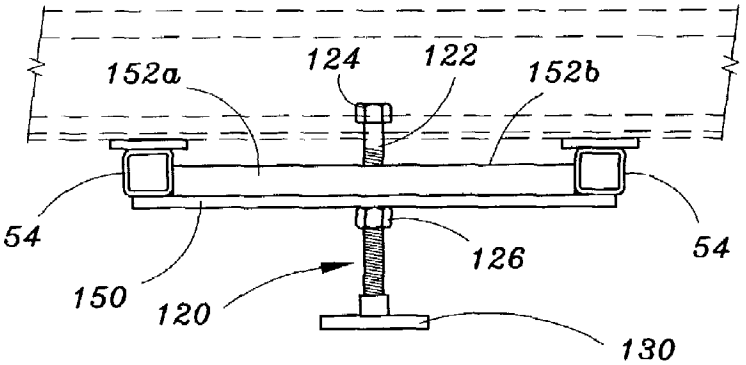
FIG. 12-15 are side elevational views of one of the jack devices that are mounted along the outer edges of the panels in various configurations.
Figure 15:
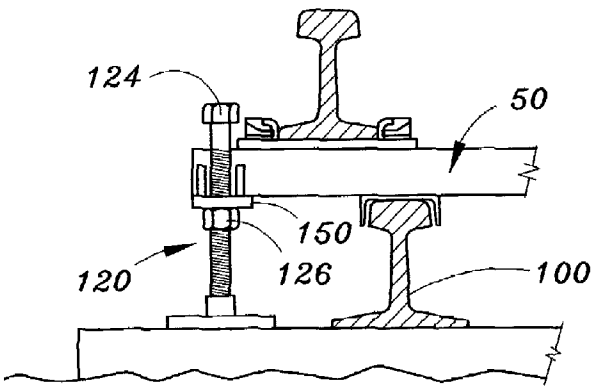
Figure 12:
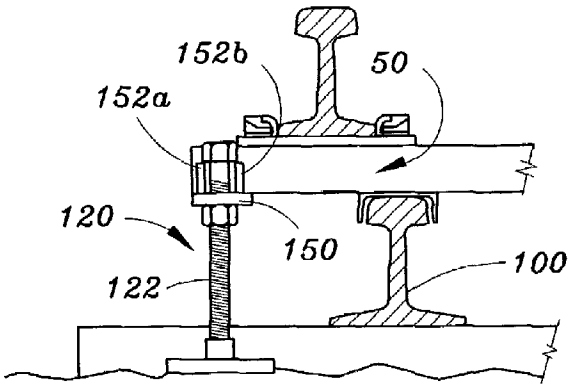
Figure 14:
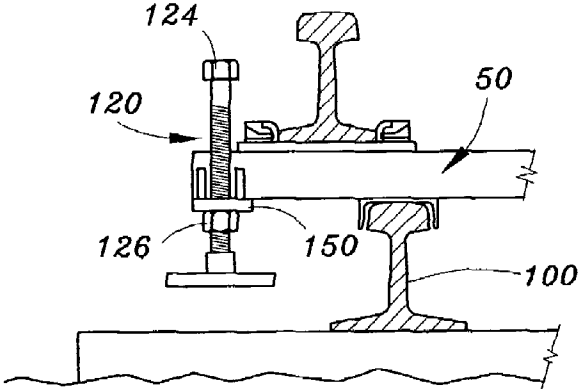
Figure 16:
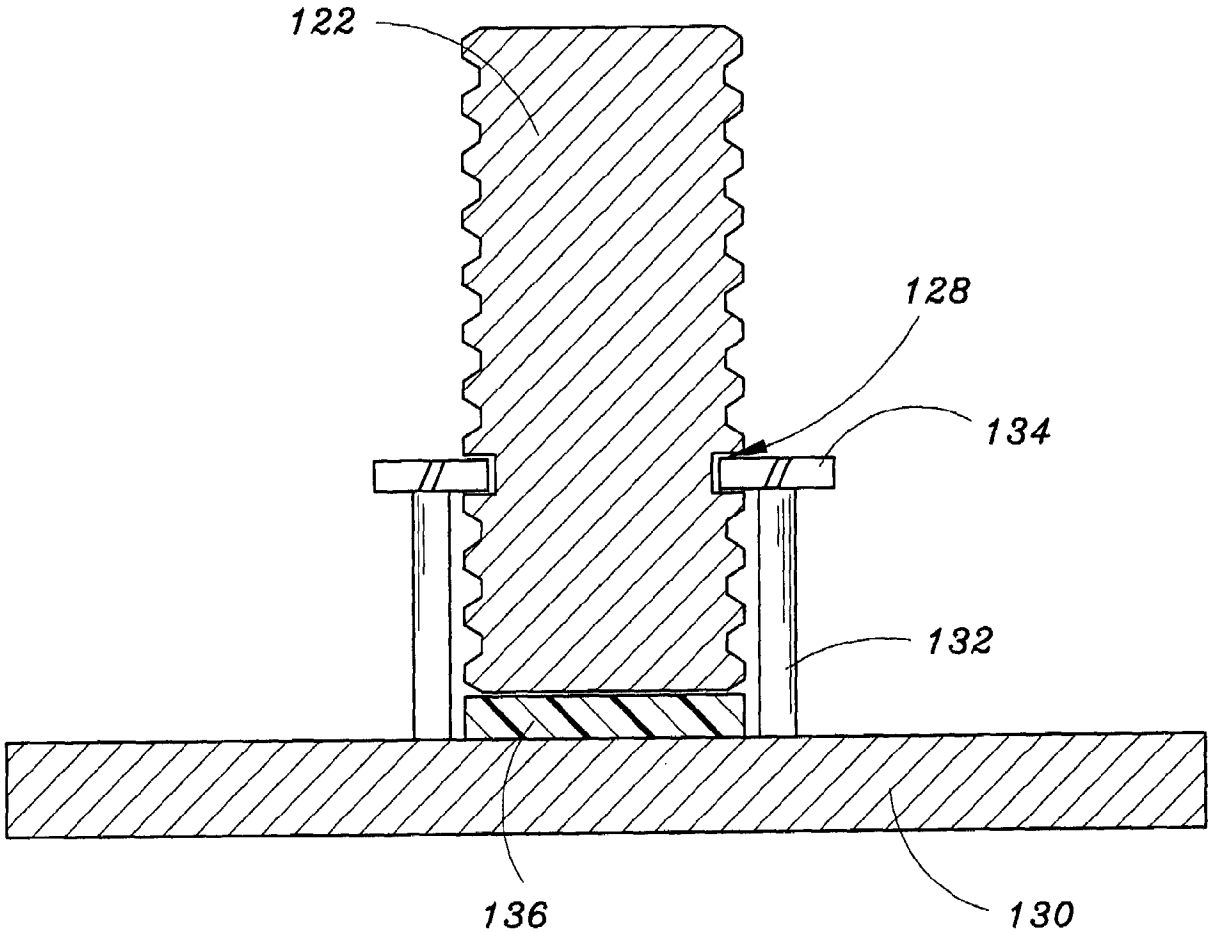
FIG. 16 is a detail side elevational view of the lower section of one of the jack devices.
Figure 17:
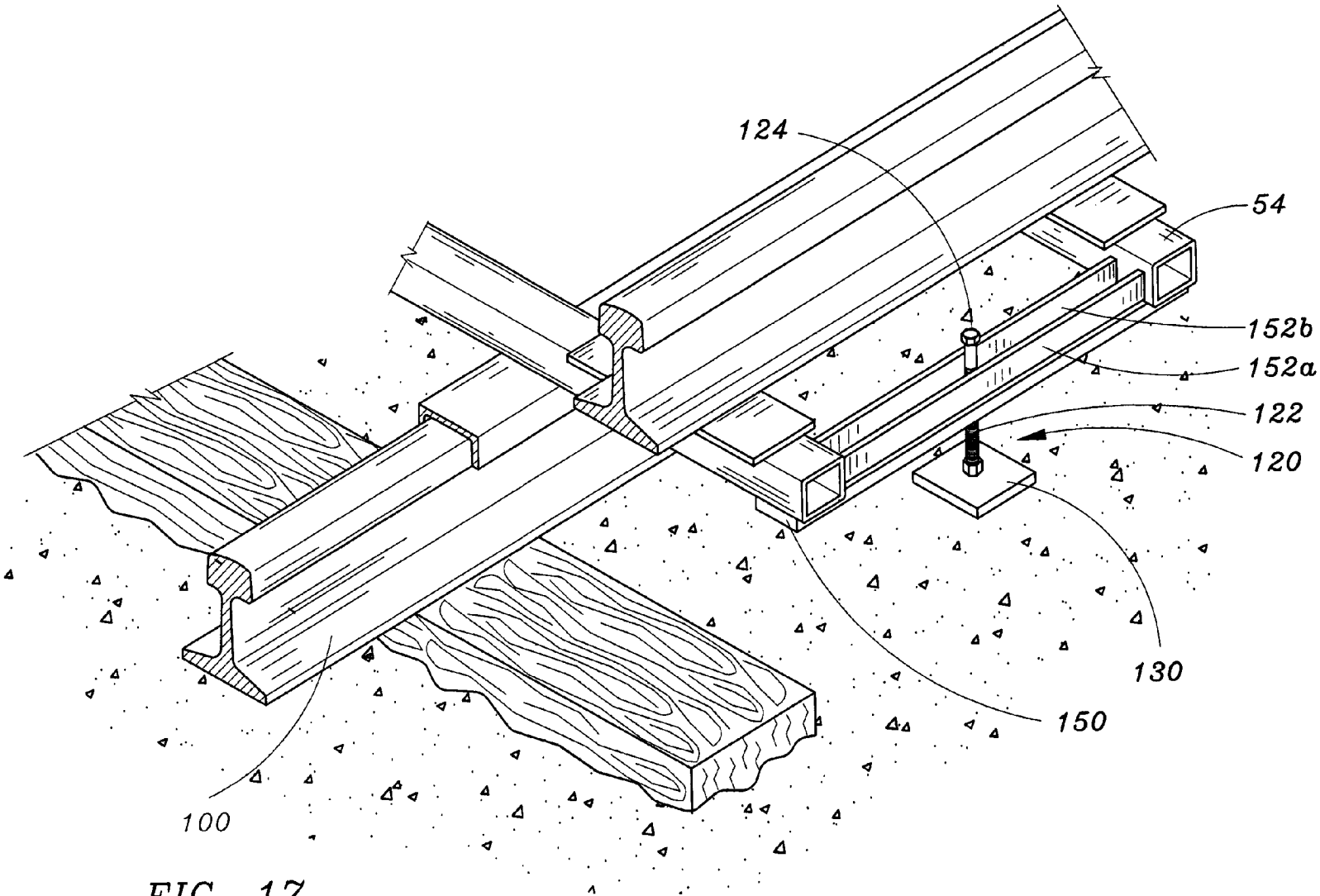
FIG. 17 is a perspective view of one of the jack devices that are mounted along the outer edges of the pannels.

FIG. 3 shows turnout panel 30 which is connected to turnout panel 20 such that the parallel rails 22*a* and 22*b* of turnout panel 20 extend into and connect with the parallel rails 32*a* and 32*b* of turnout panel 30. This connection and extension of the portable turnout system 10 continues through FIGS. 4 and 5 as turnout panel 40 and turnout panel 50 are connected in turn to the turnout panels 20 and 30 already connected to ramp section 12. One important feature of the present invention is the use of outrigger devices 94, which are shown best in FIG. 11 and in connection with turnout panels 30, 40, and 50. In the preferred embodiment, the outrigger devices 94 would include an adjustable outside leg brace 96 and horizontally extending I-beam 98 which is secured to a rearward tie on the main line 100 by a track spike or the like. A plurality of outrigger devices 94 are used in connection with the portable turnout system 10 to provide support for the turnout panels 30, 40, and 50 as they deviate from main line 100 until an appropriate earthwork can be created to support the remaining turnout panels 60, 70, 80, and 90. The adjustable height of the outrigger device 94 permits its use in many different situations in spite of the height differential between the adjacent ground and the main line 100. It should be noted, however, that numerous different types of devices other than the outrigger devices 94, as shown in FIG. 11, may be used in connection with the present invention for height adjustment for the present invention. It has been found, however, that the outrigger devices 94 provide a simple and elegant solution to the question of how best to support the portable turnout system 10 of the present invention.

Up until turnout panel 50, the curvature of the portable turnout system 10 has been outwards away from the main line 100. However, at this point, the curvature is reversed beginning with turnout panel 60 and each of turnout panels 60, 70, 80, and 90 reverse the curvature of turnout panels 20, 30, 40, and 50 such that the far end of the portable turnout system 10 at the end of turnout panel 90 extends generally parallel with the main line 100. It should be noted that the connections of the turnout panels 20, 30, 40, 50, 60, 70, 80, and 90 to one another would be done by any appropriate means, but it has been found that simple joint bar connections work quite well with the portable turnout system 10 of the present invention and therefore are preferred for use therewith.

Once the portable turnout system 10 is completed, the temporary spur line 102 would be affixed to the far end of the portable turnout system 10 at the end of turnout panel 90 and the temporary spur line 102 may extend for whatever distance is necessary to accommodate the repair machinery. It is quite common, however, for the temporary spur line 102 to extend upwards of a mile depending on the equipment needed for the repair.

Prior to use of the portable turnout system 10, however, the jack devices 120 would be operated in the following manner to securely mount the system on the main rail 100. As each of the jack devices 120 operate in a similar manner regardless of the particular panel 20, 30, 40, 50, 60, 70, 80 and 90 on which the jack device 120 is mounted, and therefore the following description of the use of a jack device 120 on turnout panel 20 should be understood to apply generally to all other jack devices 120 on all other turnout panels 30, 40, 50 and 60. Once the turnout panel 20 is placed on the main line 100, it still is prone to wobble until the outer edges of the turnout panel 20 are stabilized. Each of the jack devices 120 would be engaged by a wrench, pneumatic torque wrench or other such nut-engaging device on the engagement nut 124 atop the acme screw rod 122. Rotation of the engagement nut 124 rotates the acme screw rod 122 within the mounting nut 126 to extend the acme screw rod 122 downwards below the mounting plate 150 on turnout panel 20. The foot plate 130 eventually contacts the railroad tie 104 positioned beneath the jack device 120 and thus stops turning while the acme screw rod 122 continues to rotate and extend downwards to level the turnout panel 20. Due to the friction-reducing disk 136 constructed of UHMW polyethylene, the acme screw rod 122 will not frictionally engage the foot plate 130 thus permitting the jack device 120 to function smoothly. Once the jack device 120 has been extended the desired distance to level the turnout panel 20 on the main line 100, each successive jack device 120 would be operated in the same manner until the turnout panel 20 is securely and safely mounted on the main line for use thereof.

Two possibilities emerge for removal of the portable turnout system 10 from the main line 100. The first is the dismantling of the portable turnout system 10 into the various sections, including ramp section 12 and turnout panels 20, 30, 40, 50, 60, 70, 80 and 90. Another alternative is to merely shift the entire portable turnout system 10 off of the main line 100 by lifting the portable turnout system 10 with a plurality of cranes and shifting it onto the outrigger devices 94 mounted adjacent the main line 100. As the portable turnout system 10 is very stable, structurally speaking, either solution is acceptable, depending on the needs of the user of the present invention.

It is to be understood that numerous additions, modifications and substitutions may be made to the portable turnout system 10 of the present invention which fall within the intended broad scope of the above description. For example, the exact size, shape and construction materials used in connection with the portable turnout system 10 and the portable transfer track 200 may be modified or changed depending upon the needs of the user of the present invention, and such modifications should be understood to be within the scope of this disclosure. In fact, it should be noted that although the present invention is shown as providing a transfer to a spur line which runs generally parallel with the main line 100, the spur line may extend in many different directions relative to the main line 100 depending on the surrounding terrain, and the portable transfer track 200 can be designed to accommodate such alternate spur line directions. Furthermore, the portable turnout system 10 may be used for both left hand and right hand turnouts merely by reversing the positioning of turnout panels 20-90, as was previously discussed, and it should be noted that the same turnout panels 20-90 are used for both left hand and right hand turnouts, and such modification is clearly discussed in this disclosure and constitutes an important functional feature of the present invention. Also, the precise types of connections between the turnout panels and the ramp section are not critical to the present invention so long as all connections are stable and sturdy. The turnout panels 20-90 and the ramp section 12 each may also include pickup points for connection by a crane or the like for easy transfer and placement of the sections. Additionally, the jack devices 120 may be modified or changed so long as their basic functions of leveling and securing the turnout panels on the main line are maintained. Finally, although the present invention has been described as including outrigger devices 94, functionally equivalent devices may be substituted for the outrigger devices 94 without affecting the scope of the present invention.

There has therefore been shown and described a portable turnout system 10 which accomplishes at least all of its intended objectives.

We claim:

1. A portable turnout system for temporary connection of a rail line to a spur line comprising:

a ramp section having a frame and two parallel rails mounted on said frame, said parallel rails each having a forward end and a rearward end higher than said forward end such that said parallel rails have a positive grade from said forward end to said rearward end, said ramp section further including two parallel main line engagement plates mounted on said frame and extending below said parallel rails and a plurality of rail support struts extending between adjacent ones of said two main line engagement plates and said parallel rails such that said parallel rails are supported with said positive grade from said forward end to said rearward end;

a portable transfer track including at least one portable track section having a frame and two parallel rails mounted on said frame, said portable transfer track releasably connectable at one end thereof to said rearward end of said parallel rails of said ramp section in an elevated position above the rail line;

at least one portable transfer track support device operative to support and stabilize said portable transfer track in said elevated position above the rail line; and said portable transfer track releasably connectable at the opposite end thereof to a spur line whereby a temporary turnout from the rail line to the spur line is constructed.

2. The portable turnout system of claim 1 wherein each of said at least one portable track section is curved.

3. The portable turnout system of claim 2 wherein said frame of each of said at least one portable track section further comprises a plurality of cross beams extending between and connecting said parallel rails and at least one main line rail engagement channel mounted below said plurality of cross beams, said at least one main line rail engagement channel having a generally inverted cross-sectional C-shape and being operative to extend over the main line positioned therebeneath to both protect the main line and provide additional structural and positional stability for said at least one portable track section.

4. The portable turnout system of claim 1 wherein said portable transfer track is releasably connected to said ramp section by a bolted rail connection whereby said parallel rails of said ramp section are connected directly to said parallel rails of said at least one portable track section.

5. The portable turnout system of claim 1 wherein said at least one portable transfer track support device comprises a jack device including a mounting plate mountable on the underside of said at least one portable track section, an extendable screw rod mounted on said mounting plate and a foot plate mounted on the lower end of said extendable screw rod, said jack device operative to extend said extendable screw rod downwards until said foot plate contacts a railroad tie on the main line therebeneath thereby securely and safely mounting said at least one portable track section on the main line.

6. The portable turnout system of claim 1 further comprising a plurality of outrigger devices each including an adjustable outside leg brace and a generally horizontally extending support beam which is operative to be secured to a railroad tie on the main line by a securement device, said plurality of outrigger devices operative to provide support for said portable transfer track as it deviates from the main line towards the spur line.

7. A portable turnout system for temporary connection of a rail line to a spur line comprising:

a ramp section having a frame and two parallel rails mounted on said frame, said parallel rails each having a forward end and a rearward end higher than said forward end such that said parallel rails have a positive grade from said forward end to said rearward end, said ramp section further including two parallel main line engagement plates mounted on said frame and extending below said parallel rails and a plurality of rail support struts extending between adjacent ones of said two main line engagement plates and said parallel rails such that said parallel rails are supported with said positive grade from said forward end to said rearward end;

a portable transfer track including at least two portable track sections each having a frame and two parallel rails mounted on said frame, a first one of said at least two portable track sections being curved in a first direction, a last one of said at least two portable track sections being curved in a second direction opposite said first direction whereby said portable transfer track is operative to connect the rail line to a spur line extending generally parallel with the rail line; said portable transfer track releasably connectable at one end thereof to said rearward end of said parallel rails of said ramp section in an elevated position above the rail line;

at least one portable transfer track support device operative to support and stabilize said portable transfer track in said elevated position above the rail line; and said portable transfer track releasably connectable at the opposite end thereof to a spur line whereby a temporary turnout from the rail line to the spur line is constructed.

8. The portable turnout system of claim 7 wherein said portable transfer track is releasably connected to said ramp section by a bolted rail connection whereby said parallel rails of said ramp section are connected directly to said parallel rails of one of at least two said portable track sections.

9. The portable turnout system of claim 7 wherein said at least one portable transfer track support device comprises a jack device including a mounting plate mountable on the underside of said at least two portable track sections, an extendable screw rod mounted on said mounting plate and a foot plate mounted on the lower end of said extendable screw rod, said jack device operative to extend said extendable screw rod downwards until said foot plate contacts a railroad tie on the main line therebeneath thereby securely and safely mounting said at least two portable track sections on the main line.

10. The portable turnout system of claim 7 further comprising a plurality of outrigger devices each including an adjustable outside leg brace and a generally horizontally extending support beam which is operative to be secured to a railroad tie on the main line by a securement device, said plurality of outrigger devices operative to provide support for said portable transfer track as it deviates from the main line towards the spur line.

11. A portable turnout system for temporary connection of a rail line to a spur line comprising:

a ramp section having a frame and two parallel rails mounted on said frame, said parallel rails each having a forward end and a rearward end higher than said forward end such that said parallel rails have a positive grade from said forward end to said rearward end;

a portable transfer track including at least two portable track sections each having a frame and two parallel rails mounted on said frame, a first one of said at least two portable track sections being curved in a first direction, a last one of said at least two portable track sections being curved in a second direction opposite said first direction whereby said portable transfer track is operative to connect the rail line to a spur line extending generally parallel with the rail line;

said portable transfer track releasably connectable at one end thereof to said rearward end of said parallel rails of said ramp section in an elevated position above the rail line;

at least one portable transfer track support device operative to support and stabilize said portable transfer track in said elevated position above the rail line;

each of said at least two portable track sections further including a plurality of cross beams extending between and connecting said parallel rails and at least one main line rail engagement channel mounted below said plurality of cross beams, said at least one main line rail engagement channel having a generally inverted cross-sectional C-shape and being operative to extend over the main line positioned therebeneath to both protect the main line and provide additional structural and positional stability for said at least two portable track sections; and said portable transfer track releasably connectable at the opposite end thereof to a spur line whereby a temporary turnout from the rail line to the spur line is constructed.

* * * * *